US011510020B2

(12) United States Patent
Dickmann et al.

(10) Patent No.: US 11,510,020 B2
(45) Date of Patent: Nov. 22, 2022

(54) SYSTEMS AND METHODS FOR COORDINATING RENDERING OF A REMOTE AUDIO STREAM BY BINAURAL HEARING DEVICES

(71) Applicant: SONOVA AG, Staefa (CH)

(72) Inventors: Georg Dickmann, Ebmatingen (CH); Daniel Lucas-Hirtz, Rapperswil (CH); Doris Zahnd, Bäretswil (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/387,824

(22) Filed: Jul. 28, 2021

(65) Prior Publication Data

US 2021/0360357 A1 Nov. 18, 2021

Related U.S. Application Data

(63) Continuation-in-part of application No. 16/706,387, filed on Dec. 6, 2019, now Pat. No. 11,089,411.

(30) Foreign Application Priority Data

Dec. 14, 2018 (GB) ..... 1820372

(51) Int. Cl.
*H04R 25/00* (2006.01)

(52) U.S. Cl.
CPC ..... *H04R 25/552* (2013.01); *H04R 25/554* (2013.01); *H04R 2225/55* (2013.01)

(58) Field of Classification Search
CPC ..... H04R 25/552; H04R 25/558; H04R 2225/41; H04R 2225/55
USPC ..... 381/315
See application file for complete search history.

(56) References Cited

U.S. PATENT DOCUMENTS

| | | | |
|---|---|---|---|
| 7,016,510 | B2 | 3/2006 | Arndt |
| 8,126,175 | B2 | 2/2012 | Tateno et al. |
| 2012/0002830 | A1 | 1/2012 | Solum |
| 2013/0108058 | A1 | 5/2013 | Launer |
| 2015/0110315 | A1 | 4/2015 | Callias |
| 2017/0311092 | A1 | 10/2017 | Secall |
| 2018/0234777 | A1 | 8/2018 | Roeck |
| 2020/0045489 | A1 | 2/2020 | Merks |

FOREIGN PATENT DOCUMENTS

| | | |
|---|---|---|
| EP | 1558059 | 7/2005 |
| EP | 2590436 | 5/2013 |
| WO | 2014184394 | 11/2014 |

OTHER PUBLICATIONS

GB Search Report received in GB Application No. 1820372.9.

*Primary Examiner* — Sean H Nguyen
(74) *Attorney, Agent, or Firm* — ALG Intellectual Property, LLC

(57) ABSTRACT

A binaural hearing system includes first and second hearing devices communicatively coupled by way of a binaural communication link. The first hearing device determines that a signal quality measure of a wireless signal transmitted by the remote audio source is greater than an upper threshold level. In response, both hearing devices enter a wireless audio rendering mode in which they render a remote audio stream from the remote audio source to a user. While operating in the wireless audio rendering mode, both hearing devices determine that a signal quality measure of the remote audio stream drops below a lower threshold level. In response to this determination, both hearing devices exit the wireless audio rendering mode.

20 Claims, 4 Drawing Sheets

SYSTEMS AND METHODS FOR COORDINATING RENDERING OF A REMOTE AUDIO STREAM BY BINAURAL HEARING DEVICES

RELATED APPLICATIONS

The present application is a continuation-in-part of U.S. patent application Ser. No. 16/706,387, filed on Dec. 6, 2019, which claims priority to GB Patent Application No. 1820372.9, filed on Dec. 14, 2018, the contents of which are hereby incorporated by reference in their entirety.

BACKGROUND INFORMATION

A binaural hearing system includes two hearing devices (e.g., hearing aids), one for each ear. Binaural hearing systems often provide users with improved sound quality, perception, and localization compared to monaural hearing device configurations.

It is often desirable for a binaural hearing system to render a remote audio stream that is wirelessly transmitted by a remote audio source. For example, when a user enters a room in which a television is presenting a program, it may be desirable for the user's binaural hearing system to automatically begin rendering an audio stream output by the television so that the user may more easily hear audio associated with the program. When the user exits the room, the binaural hearing system should stop rendering the audio stream.

To this end, each hearing device in a conventional binaural hearing system may independently monitor a signal quality measure (e.g., signal strength) of a wireless signal transmitted by the remote audio source. When the first hearing device detects that the signal quality measure of the wireless signal goes above an upper threshold level, the first hearing device enters a wireless audio rendering mode in which the first hearing device starts rendering a remote audio stream from the remote audio source to the user. While in the wireless audio rendering mode, the first hearing device monitors the signal quality measure of the remote audio stream. When the signal quality measure goes below a lower threshold level, the first hearing device exits the wireless audio rendering mode to cease rendering the remote audio stream. The second hearing device enters and exits the wireless audio rendering mode in a similar, but independent, manner.

Unfortunately, head shadowing and other factors may cause signal quality measures of signals transmitted by the remote audio source to be different at both hearing devices at any given moment. This may cause the first and second hearing devices in a conventional binaural hearing system to enter and/or exit the wireless audio rendering mode at different times. This may result in a poor and disjointed user experience, such as binaural artefacts being presented to the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
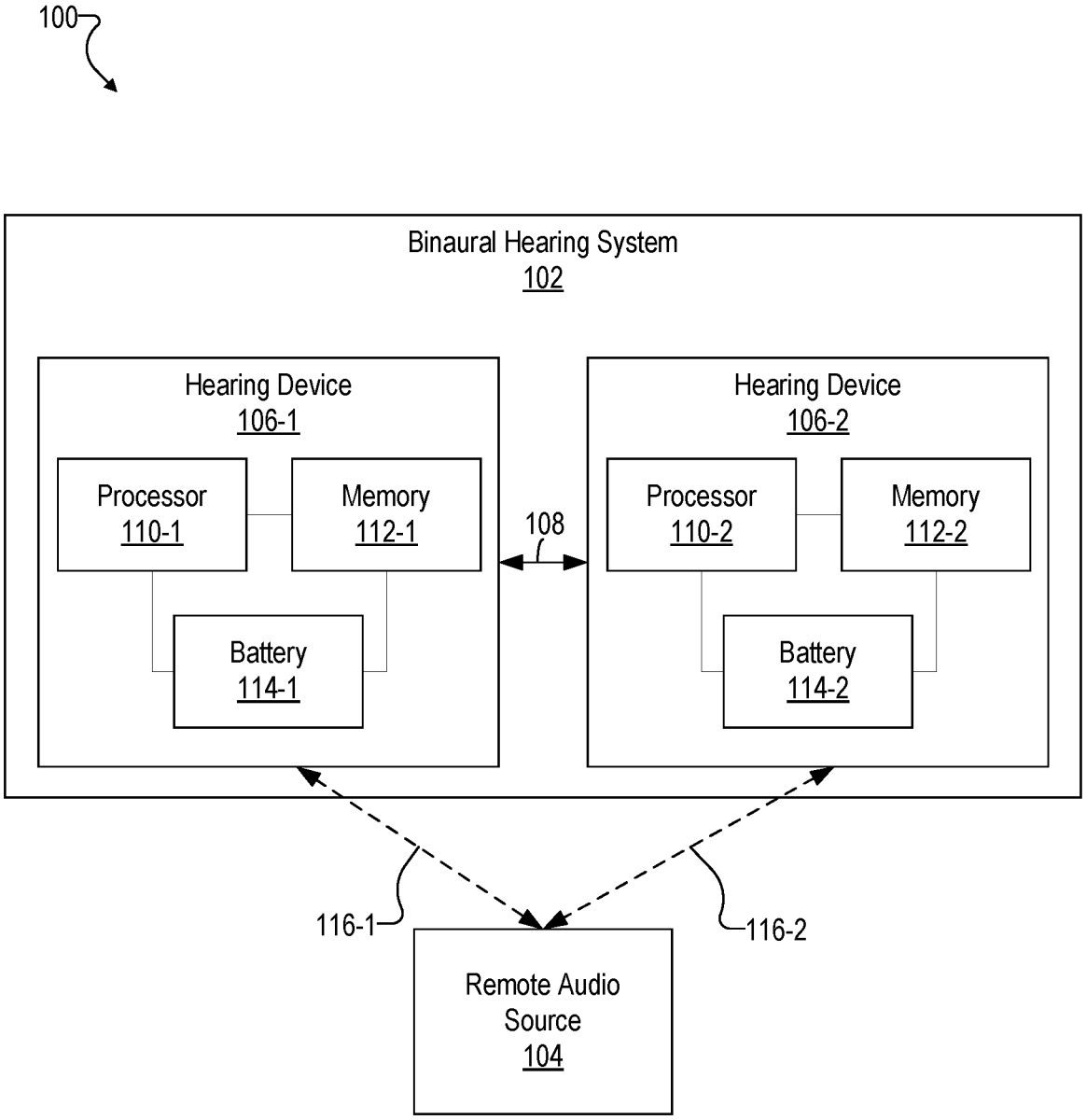
FIG. 1 illustrates an exemplary configuration in which a binaural hearing system is configured to selectively render a remote audio stream wirelessly transmitted by a remote audio source according to principles described herein.

Systems and methods for coordinating rendering of a remote audio stream by first and second hearing devices in a binaural hearing system are described herein. The systems and methods described herein may coordinate a synchronized entry into and a synchronized exit out of a wireless audio rendering mode by the first and second hearing devices included in the binaural hearing system.

As will be described in more detail below, the binaural hearing system may enable only the first hearing device to monitor for a wireless signal that is transmitted by the remote audio source while the binaural hearing system is not connected to the remote audio source (i.e., while neither hearing device is in the wireless audio rendering mode). The second hearing device is configured to abstain from monitoring for the remote audio stream while the binaural hearing system is not connected to the remote audio source.

When the first hearing device detects a presence of the wireless signal, the first hearing device may monitor a signal quality measure of the remote audio stream. If the first hearing device determines that the signal quality measure of the wireless signal is greater than an upper threshold level, the first hearing device may cause both the first hearing device and the second hearing device to enter a wireless audio rendering mode in a synchronized manner. For example, in response to determining that the signal quality measure of the wireless signal is greater than the upper threshold level, the first hearing device may transmit a command to the second hearing device by way of a binaural communication link. The command is configured to direct the second hearing device to enter the wireless audio rendering mode in coordination with (e.g., at substantially the same time as or within a certain amount of time) the first hearing device.

While operating in accordance with the wireless audio rendering mode, the first and second hearing devices may render the remote audio stream to the user. For example, the first and second hearing devices may acoustically present audio content included in the remote audio stream to the user.

While operating in accordance with the wireless audio rendering mode, the first and second hearing devices may each monitor a signal quality measure of a remote audio stream from the remote audio source. The signal quality measure may be signal strength, packet error rate, a parameter related to packet concealment, etc. When the first and second hearing devices both detect that the signal quality measure of the remote audio stream drops below a lower threshold level that is lower than the upper threshold level, the first and second hearing devices exit the wireless audio rendering mode in a synchronous or coordinated manner (e.g., at substantially the same time).

The systems and methods described herein allow the hearing devices to synchronize entry to the wireless audio rending mode based on only one of the hearing devices monitoring a wireless signal transmitted by a remote audio source. Advantageously, this may reduce the burden (e.g., current drain, scheduling, resource consumption, etc.) of monitoring the wireless signal to a single hearing device. This may improve battery life of the binaural hearing system as a whole, and spare resources on the hearing device that abstains from monitoring the wireless signal.

Furthermore, the systems and methods described herein allow the hearing devices to synchronize exit from the wireless audio rending mode in response to, but not before, signal quality measures of the remote audio stream received at each hearing device drop below a lower threshold level. Advantageously, this ensures that both hearing devices exit the wireless audio rendering mode at substantially the same time, thereby resulting in an improved and more natural hearing experience for a user of the binaural hearing system.

FIG. 1 illustrates an exemplary configuration 100 in which a binaural hearing system 102 is configured to selectively render a remote audio stream wirelessly transmitted by a remote audio source 104. As shown, binaural hearing system 102 includes a first hearing device 106-1 and a second hearing device 106-2 (collectively "hearing devices 106"). Each element shown in configuration 100 will now be described in detail.

Remote audio source 104 may be implemented by any computing device configured to output a remote audio stream that may be received and rendered by hearing devices 106. For example, remote audio source 104 may be implemented by a mobile device (e.g., a mobile phone such as a smartphone, a tablet computer, a laptop computer, a mobile gaming device), a desktop computer, a television, a speaker, a wireless microphone, etc. In some examples, remote audio source 104 is connected to another device that actually generates the remote audio stream and/or the audio content included in the remote audio stream.

The remote audio stream output by remote audio source 104 may include any suitable audio content (e.g., speech, music, or other sounds) and may be of any suitable format. For example, the remote audio stream may be modulated, encoded, or otherwise processed prior to transmission by remote audio source 104.

Remote audio source 104 may wirelessly transmit the remote audio stream in any suitable manner. For example, remote audio source 104 may broadcast, multicast, unicast, or otherwise transmit the remote audio stream. In the particular example of FIG. 1, a user of binaural hearing system 102 cannot perceive the remote audio stream unless hearing devices 106 enter a wireless audio rendering mode in which hearing devices 106 render the remote audio stream to the user.

Hearing devices 106 may each be implemented by any type of hearing device configured to provide or enhance hearing to a user of binaural hearing system 102. For example, hearing devices 106 may each be implemented by a hearing aid configured to amplify audio content to a user, a sound processor included in a cochlear implant system configured to apply electrical stimulation representative of audio content to a user, a sound processor included in a stimulation system configured to apply electrical and acoustic stimulation to a user, or any other suitable hearing prosthesis. In some examples, hearing device 106-1 is of a different type than hearing device 106-2. For example, hearing device 106-1 may be a hearing aid and hearing device 106-2 may be a sound processor included in a cochlear implant system.

As shown, each hearing device 106 includes a processor, memory, and a battery (among other components). For example, hearing device 106-1 includes processor 110-1, memory 112-1, and battery 114-1. Likewise, hearing device 106-2 includes processor 110-2, memory 112-2, and battery 114-2.

Processors 110 are configured to perform various processing functions, such as monitoring a wireless signal (e.g., a remote audio stream or a wireless signal that does not include audio content) transmitted by the remote audio source (e.g., by monitoring for a presence of the wireless signal and/or by monitoring a signal quality measure of the wireless signal), entering a wireless audio rendering mode, operating in accordance with the wireless audio rendering mode, exiting the wireless audio rendering mode, etc. Processors 110 may each be implemented by any suitable combination of hardware and software.

Memory 112 may be implemented by any suitable type of storage medium and may maintain (e.g., store) data utilized by processors 110. For example, memory 112 may store data representative of an operation program that specifies how each processor 110 processes and delivers audio content to a user. To illustrate, memory 112-1 may maintain data representative of a first program that causes processor 110-1 to operate in a wireless audio rendering mode and a second program that causes processor 110-2 to operate in a normal mode in which processor 110-2 amplifies ambient sound detected by a microphone that is a part of hearing device 106-1. Memory 112-2 may maintain data representative of similar programs. In some examples, memory 112 in both hearing devices 106 maintains data representative of upper and lower threshold levels.

Battery 114-1 is configured to provide operating power for processor 110-1, memory 112-1, and/or other components included in hearing device 106-1. Likewise, battery 114-2 is configured to provide operating power for processor 110-2, memory 112-2, and/or other components included in hearing device 106-2. In some examples, batteries 114 are rechargeable. Alternatively, batteries 114 are non-rechargeable. Batteries 114 may have any suitable capacity, discharge profile, and/or other characteristic as may serve a particular implementation.

Hearing devices 106 may communicate with each other (e.g., by transmitting data) by way of a binaural communication link 108 that interconnects hearing devices 106. Binaural communication link 108 may include any suitable wireless or wired communication link as may serve a particular implementation.

Each hearing device 106-1 and 106-2 may individually establish a wireless connection 116 with remote audio source 104. For example, wireless connection 116-1 may be selectively established between hearing device 106-1 and remote audio source 104, and wireless connection 116-2 may be selectively established between hearing device 106-2 and remote audio source 104. Wireless connections 116 are represented by dashed lines in FIG. 1 to indicate that wireless connections 116 may be selectively established or broken depending, for example, on a signal quality measure of the remote audio stream output by remote audio source 104.

Hearing devices 106 may establish a wireless connection 116 with remote audio source 104 in any suitable manner. For example, hearing device 106-1 may establish wireless connection 116-1 with remote audio source 104 by simply switching to a wireless audio rendering mode in which hearing device 106-1 begins to render the remote audio stream. In this example, which may occur when the remote audio stream is broadcast or multicast, a "connection" between hearing device 106-1 and remote audio source 104 may not be a connection that is known to or recognized by remote audio source 104. In other words, in this example, no handshaking information or other connection-specific data is exchanged between hearing device 106-1 and remote audio source 104. As another example (e.g., in the case of a unicast remote audio stream), hearing device 106-1 may establish wireless connection 116-1 by exchanging handshaking information with remote audio source 104 and/or transmitting data representative of a connection request to remote audio source 104. Hearing device 106-2 may similarly establish wireless connection 116-2 with remote audio source 104 in any suitable manner.

Hearing devices 106 may be wirelessly disconnected from remote audio source 104 in any suitable manner. For example, hearing device 106-1 may be wirelessly disconnected from remote audio source 104 by simply not being in the wireless audio rendering mode in which hearing device 106-1 renders a wireless audio stream from remote audio source 104.

Figure 2:
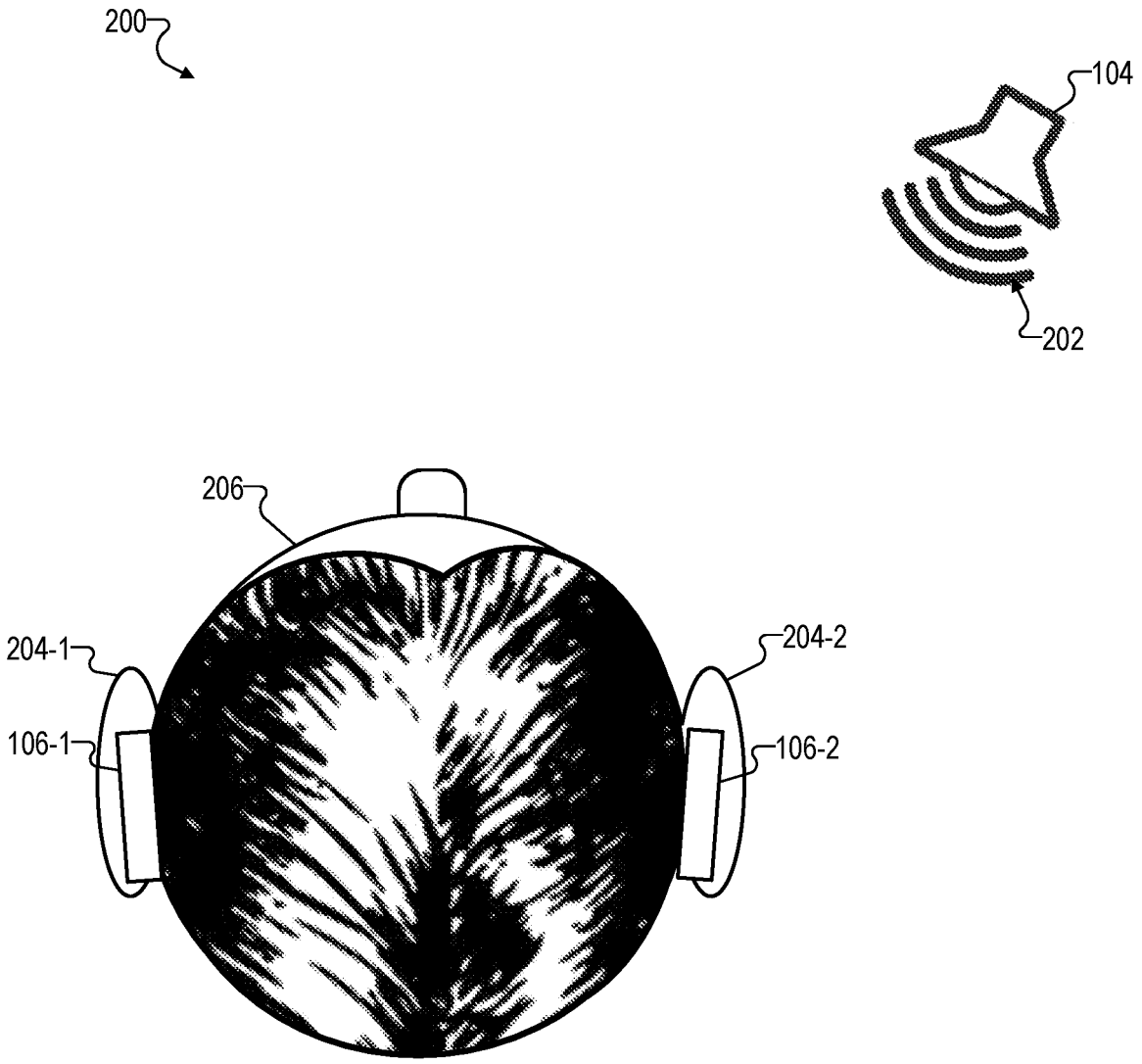
FIG. 2 illustrates an exemplary implementation of the configuration of FIG. 1 according to principles described herein.

FIG. 2 illustrates an exemplary implementation 200 of configuration 100. As shown, remote audio source 104 wirelessly transmits a remote audio stream 202. As mentioned, remote audio stream 202 may be broadcast, multicast, unicast, or otherwise transmitted by remote audio source 104.

Hearing devices 106 are positioned at ears 204 of a user 206. For example, as shown, hearing device 106-1 is positioned at ear 204-1 and hearing device 106-2 is positioned at ear 204-2. In this configuration, hearing device 106-1 is configured to render audio to ear 204-1 and hearing device 106-2 is configured to render audio to ear 204-2. While hearing device 106-1 is shown to be associated with left ear 204-1 and hearing device 106-2 is shown to be associated with right ear 204-2 in FIG. 2, it will be recognized that hearing device 106-1 may alternatively be associated with right ear 204-2 and hearing device 106-2 may alternatively be associated with left ear 204-1.

As shown, the relative distance of each of hearing devices 106 to remote audio source 104 may vary depending on an orientation of a head of user 206 with respect to remote audio source 104. In the example of FIG. 2, hearing device 106-2 is closer to remote audio source 104 than hearing device 106-1. Hence, a signal quality measure of remote audio stream 202 may be stronger at hearing device 106-2 than a signal quality measure of remote audio stream 202 at hearing device 106-1. Other factors, such as head shadowing and environmental factors, may also affect the relative signal quality measure of remote audio stream 202 at hearing devices 106. To minimize (e.g., obviate) an effect of these factors, hearing devices 106 may be configured to enter and exit a wireless audio rendering mode in a synchronous or coordinated manner.

To this end, hearing device 106-1 may be configured to operate as a primary hearing device and hearing device 106-2 may be configured to operate as secondary hearing device. As the primary hearing device, hearing device 106-1 may be configured to monitor a wireless signal transmitted by remote audio source 104 while hearing devices 106 are wirelessly disconnected from remote audio source 104 (i.e., not rendering remote audio stream 202). The wireless signal monitored by hearing device 106-1 may be remote audio stream 202 in some cases. In other cases, the wireless signal monitored by hearing device 106-1 may be a signal that does not include audio content. For purposes of the examples provided herein, the wireless signal monitored by hearing device 106-1 is remote audio stream 202.

As the secondary hearing device, hearing device 106-2 may be configured to abstain from monitoring remote audio stream 202 while hearing devices 106 are not in the wireless audio rendering mode. It will be recognized that the primary and secondary role designations may be switched between hearing devices 106-1 and 106-2 in some alternative configurations. For example, the primary and secondary role designations may be switched in response to user input, automatically based on one or more attributes (e.g., remaining battery life) of hearing devices 106, and/or based on any other factor. For purposes of the examples provided herein, hearing device 106-1 is the primary hearing device and hearing device 106-2 is the secondary hearing device.

Hearing device 106-1 may monitor remote audio stream 202 while hearing devices 106 are wirelessly disconnected from remote audio source 104 in any suitable manner. For example, hearing device 106-1 may be configured to monitor (e.g., scan) for a signal having predefined attributes that match attributes of remote audio stream 202. Once hearing device 106-1 determines that remote audio stream 202 is present, hearing device 106-1 may monitor remote audio stream 202 by monitoring (e.g., tracking) a signal quality measure of remote audio stream 202. For example, hearing device 106-1 may track a received signal quality measure indicator (Received Signal Strength Indicator or RSSI) of remote audio stream 202, a received channel power indicator (RCPI) of remote audio stream 202, and/or any other indicator of signal quality.

While monitoring the signal quality measure of remote audio stream 202, hearing device 106-1 may determine that the signal quality measure of remote audio stream 202 is greater than an upper threshold level. The upper threshold level may set to be high enough to ensure that both hearing devices 106 are capable of accurately receiving and rendering remote audio stream 202.

In response to hearing device 106-1 determining that the signal quality measure of remote audio stream 202 is greater than the upper threshold level, both hearing devices 106 may enter a wireless audio rendering mode. In some examples, hearing devices 106 enter the wireless audio rendering mode in a synchronous manner.

To this end, in response to hearing device 106-1 determining that the signal quality measure of remote audio stream 202 is greater than the upper threshold level, hearing device 106 may be configured to transmit a command to hearing device 106-2 by way of binaural communication link 108. The command may be configured to direct hearing device 106-2 to enter the wireless audio rendering mode at substantially the same time as hearing device 106-1. It will be recognized that hearing devices 106 may enter the wireless audio rendering mode at slightly different times. However, the time difference between when hearing devices 106 enter (and exit) the wireless audio rendering mode in the synchronous manner may be so small that the difference is not perceptible to user 206.

While operating in the wireless audio rendering mode, hearing devices 106 may render (or at least attempt to render) remote audio stream 202 to user 206. This may be performed in any suitable manner. For example, if hearing devices 106 are hearing aids, hearing devices 106 may render remote audio stream 202 by acoustically presenting audio content included in remote audio stream 202 to user 206. As another example, if hearing devices 106 are part of a cochlear implant system, hearing devices 106 may render remote audio stream 202 by presenting electrical stimulation representative of audio content included in remote audio stream 202 to user 206.

In some examples, hearing devices 106 may render remote audio stream 202 to the exclusion of other audio signals that may be present in the environment in which user 206 is located. For example, hearing devices 106 may disable their respective microphones so that the only content that is rendered to user 206 is the audio content included in remote audio stream 202. Alternatively, hearing devices 106 may still render other audio signals (e.g., with less amplification than they would when operating in a mode other than the wireless audio rendering mode) while rendering remote audio stream 202.

While operating in the wireless audio rendering mode, hearing devices 106 may both monitor a signal quality measure of remote audio stream 202. If both hearing devices 106 determine that the signal quality measure of remote audio stream 202 drops below a lower threshold level that is less than the upper threshold level, both hearing devices 106 may exit the wireless audio rendering mode in a synchronous manner, as described herein. The lower threshold level may be set to be at the minimum signal quality measure level required for both hearing devices 106 to correctly render remote audio stream 202. In this manner, the systems and methods described herein may ensure that at least one hearing device 106 is correctly rendering remote audio stream 202 up until the time that they jointly exit the wireless audio rendering mode. Alternatively, the lower threshold level may be set to be slightly above the minimum signal quality measure level required for both hearing devices 106 to correctly render remote audio stream 202. In this manner, the systems and methods described herein may ensure that both hearing devices 106 are correctly rendering remote audio stream 202 up until the time that they jointly exit the wireless audio rendering mode.

Hearing devices 106 may exit the wireless audio rendering mode in any suitable manner. For example, hearing devices 106 may exit the wireless audio rendering mode by terminating their respective wireless connections with remote audio source 104 or otherwise ceasing to render the remote audio stream 202.

Hearing devices 106 may synchronize their respective exits from the wireless audio rendering mode in any suitable manner. For example, hearing devices 106 may transmit monitoring data back and forth by way of binaural communication link 108 so that at least one of hearing devices 106 is aware of the monitoring status of both hearing devices 106. To illustrate, hearing device 106-2 may determine that the signal quality measure of remote audio stream 202 drops below the lower threshold level. Hearing device 106-2 may transmit, via binaural communication link 108, a signal to the hearing device 106-1 that indicates that the signal quality measure of remote audio stream 202 is less than the lower threshold level at hearing device 106-2. If hearing device 106-1 determines, within a predetermined amount of time after receiving the signal, that the signal quality measure of remote audio stream 202 is also less than the lower threshold level at hearing device 106-1, hearing device 106-1 may transmit a command to hearing device 106-2 via binaural communication link 108 for hearing device 106-2. The command may be configured to direct hearing device 106-2 to exit the wireless audio rendering mode in a synchronized manner with hearing device 106-1.

In some examples, one of hearing devices 106 may determine that the signal quality measure of remote audio stream 202 drops below the lower threshold level before the other hearing device 106 determines that the signal quality measure of remote audio stream 202 drops below the lower threshold level. For example, hearing device 106-1 may determine that the signal quality measure of remote audio stream 202 drops below the lower threshold level before the hearing device 106-2 determines that the signal quality measure of remote audio stream 202 drops below the lower threshold level. In this case, both hearing devices 106 may be configured to remain in the wireless audio rendering mode until hearing device 106-2 also determines that the signal quality measure of remote audio stream 202 drops below the lower threshold level.

Figure 3:
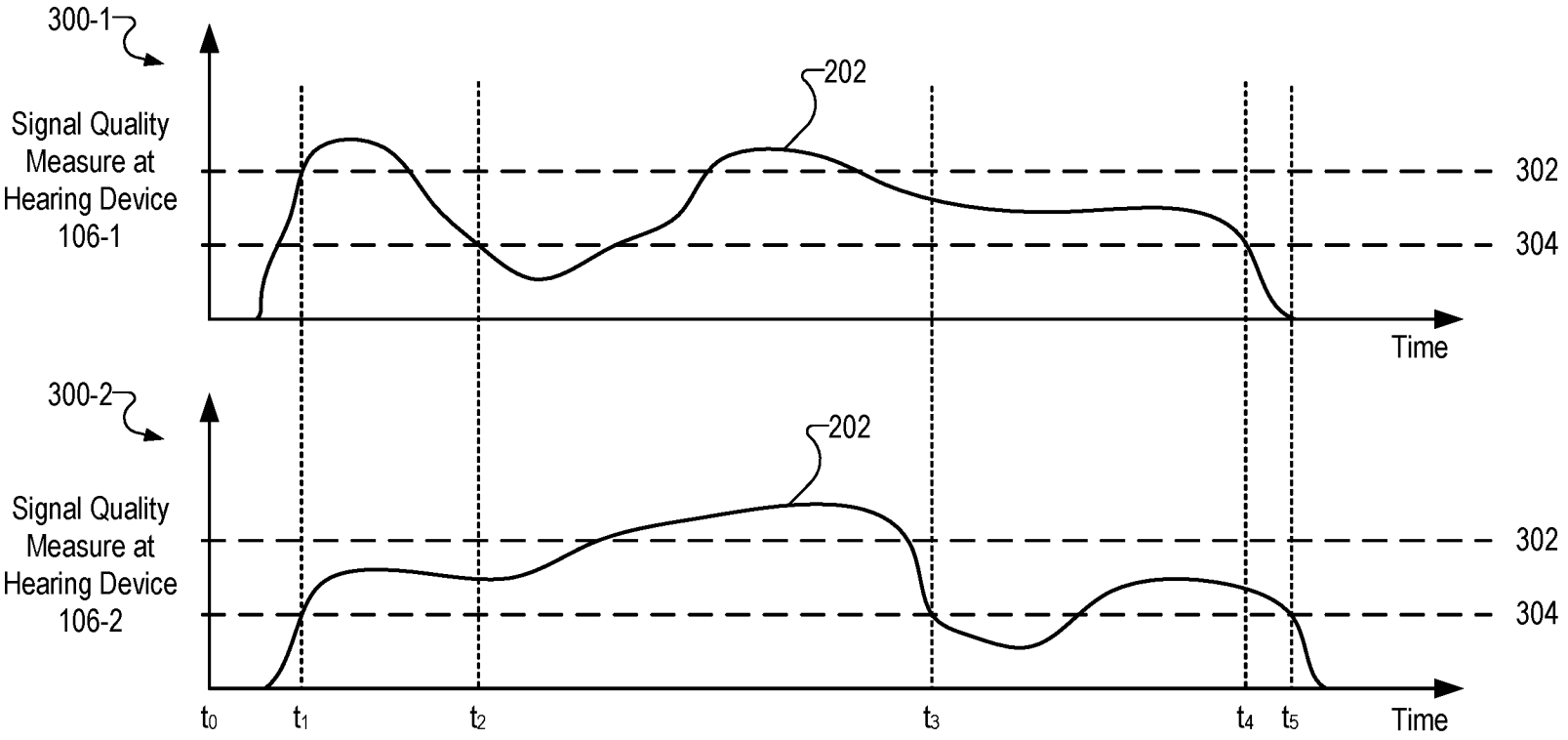
FIG. 3 shows graphs that illustrate how a signal quality measure of a remote audio stream may fluctuate over time at hearing devices included in a binaural hearing system according to principles described herein.

FIG. 3 shows graphs 300-1 and 300-2 that illustrate how the signal quality measure of remote audio stream 202 may fluctuate over time at hearing devices 106. In particular, graph 300-1 corresponds to hearing device 106-1 and graph 300-2 corresponds to hearing device 106-2. In the example of FIG. 3, hearing device 106-1 operates as the primary hearing device and hearing device 106-2 operates as the secondary hearing device.

An upper threshold level 302 and a lower threshold level 304 are shown in both graphs 300. As shown, upper threshold level 302 is greater than lower threshold level 304. Upper threshold level 302 may be set to be high enough to ensure that both hearing devices 106 correctly render remote audio stream 202 when at least one of hearing devices 106 receives remote audio stream 202 with the signal quality measure at or above this level. Lower threshold level 304 may be set to be at or slightly above the minimum signal quality measure level required for each hearing device 106 to correctly render remote audio stream 202. The difference between upper and lower threshold levels 302 and 304 may be set to maximize the amount of time that both hearing devices 106 may remain in the wireless audio rendering mode.

As shown, between times $t_0$ and $t_1$, the signal quality measure of remote audio stream 202 at both hearing devices 106 is below upper threshold level 302. This indicates that hearing devices 106 (and hence user 206) are not close enough to remote audio source 104 to begin rendering remote audio stream 202. During this time, both hearing devices 106 are wirelessly disconnected from remote audio source 104. As the primary hearing device, hearing device 106-1 monitors a signal quality measure of remote audio stream 202 while both hearing devices 106 are wirelessly disconnected from remote audio source 104. As the secondary hearing device, hearing device 106-2 abstains from monitoring the signal quality measure of remote audio stream 202.

Between times $t_0$ and $t_1$, user 206 may move closer to remote audio source 104. The signal quality measure of remote audio stream 202 at both hearing devices 106 may accordingly increase. At time $t_1$, hearing device 106-1 detects that the signal quality measure of hearing device 106-1 goes above upper threshold level 302. In response, hearing device 106-1 enters the wireless audio rendering mode and directs hearing device 106-2 to enter the wireless audio rendering mode at substantially the same time. As shown, this occurs even though the signal quality measure of remote audio stream 202 at hearing device 106-2 is still below upper threshold level 302.

Starting at time $t_1$, hearing devices 106 both operate in accordance with the wireless audio rendering mode by rendering remote audio stream 202 to the user. During this time, both hearing devices 106 also monitor the signal quality measure of remote audio stream 202. As shown, at time $t_2$, the signal quality measure of remote audio stream 202 at hearing device 106-1 goes below lower threshold level 304. However, at this time the signal quality measure of remote audio stream 202 at hearing device 106-2 is still above lower threshold level 304. Hence, as described herein, both hearing devices 106 remain in the wireless audio rendering mode (even though hearing device 106-1 may or may not be able to render remote audio stream 202).

At time $t_3$, the signal quality measure of remote audio stream 202 at hearing device 106-2 goes below lower threshold level 304. However, at this time the signal quality measure of remote audio stream 202 at hearing device 106-1 is above lower threshold level 304. Hence, as described herein, both hearing devices 106 remain in the wireless audio rendering mode (even though hearing device 106-2 may or may not be able to render remote audio stream 202).

At time $t_4$, the signal quality measure of remote audio stream 202 at hearing device 106-1 goes below lower threshold level 304. At this point, the signal quality measure of remote audio stream 202 at hearing device 106-2 is still above lower threshold level 304. However, at time $t_5$, the signal quality measure of remote audio stream 202 at hearing device 106-2 also goes below lower threshold level 304. At this point, the signal quality measure of remote audio stream 202 at both hearing devices 106 is below lower threshold level 304, which may indicate that user 206 has moved outside a hearing range of remote audio source 104. Accordingly, hearing devices 106 exit the wireless audio rendering mode in a synchronous manner. This may be performed in any of the ways described herein.

Figure 4:
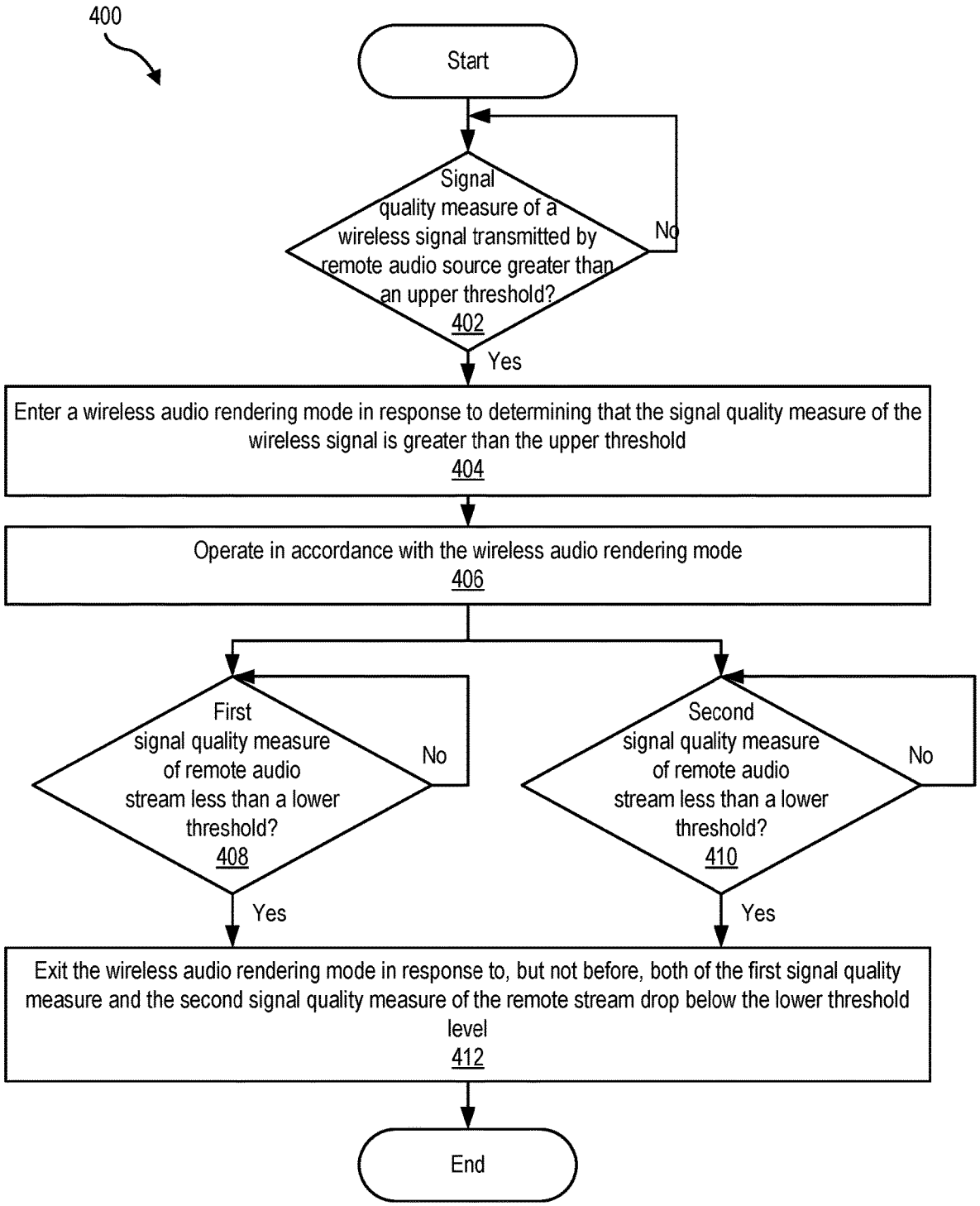
FIG. 4 illustrates an exemplary method according to principles described herein.

FIG. 4 illustrates an exemplary method 400 for coordinating rendering of a remote audio stream by hearing devices in a binaural hearing system. One or more of the operations shown in FIG. 4 may be performed by hearing devices 106-1 and 106-2 and/or any implementation thereof. While FIG. 4 illustrates exemplary operations according to one embodiment, other embodiments may omit, add to, reorder, and/or modify any of the operations shown in FIG. 4.

At operation 402, a determination is made whether a signal quality measure of a wireless signal transmitted by a remote audio source is greater than an upper threshold level. In an example, the determination may be performed by a primary hearing device (e.g., hearing device 106-1) of a binaural hearing system. Operation 402 may be performed in any of the ways described herein. In response to the signal quality measure of the wireless signal being greater than the upper threshold level, the flow continues at operation 404.

At operation 404, a wireless audio rendering mode is entered. In an example, the wireless audio rendering mode is entered by both hearing devices 106. Operation 404 may be performed in any of the ways described herein. For example, hearing device 106-1 (operating as the primary hearing device) provides a command directing the hearing device 106-2 (acting as the secondary hearing device) to enter the wireless audio rendering mode prior to both hearing devices entering the wireless audio rendering mode.

At operation 406, both hearing devices 106 operate in accordance with the wireless audio rendering mode. Operation 406 may be performed in any of the ways described herein.

At operation 408, a determination is made whether a first signal quality measure of a remote audio stream from the remote audio source is less than a lower threshold level. In an example, the first signal quality measure is for the remote audio stream received at hearing device 106-1. Operation 408 may be performed in any of the ways described herein.

At operation 410, a determination is made whether a second signal quality measure of the remote audio stream is less than a lower threshold level. In an example, the second signal quality measure is for the remote audio stream received at hearing device 106-2. Operation 410 may be performed in any of the ways described herein.

At operation 412, the wireless audio rendering mode is exited in response to, but not before, both the first signal quality measure and the second signal quality measure drop below the lower threshold level. Operation 412 may be performed in any of the ways described herein. For example, hearing device 106-2 may provide, to hearing device 106-1, a signal indicating that the second signal quality measure is below the lower threshold prior to the wireless audio rendering mode being exited. If hearing device 106-1 has also determined that the first signal quality measure of the remote audio stream is less than the lower threshold level, hearing device 106-1 may provide, to hearing device 106-2, a command directing hearing device 106-2 to exit the wireless audio rendering mode in a synchronous manner with hearing device 106-1.

In some examples, when hearing devices 106 compare signal quality measures to an upper threshold to enter a wireless audio rendering mode and to a lower threshold to exit the wireless audio rendering mode, fluctuations of the signal quality measures may, in particular when upper and lower thresholds are close to each other, cause hearing devices 106 to enter and exit the wireless audio rendering mode in within shorts periods of time, resulting in poor user experience. Accordingly, in some examples, one or more additional criteria (in addition to the signal quality measurement criteria) must be met for hearing devices 106 to enter and/or exit the wireless audio rendering mode.

For example, in some embodiments, the criterion to enter the wireless audio rendering mode is applied only if a preconfigured amount of time has elapsed since hearing devices 106 exit the wireless audio rendering mode. To this end, hearing device 106-1 and/or hearing device 106-2 may track, commencing with the exiting of both hearing devices 106 from the wireless audio rendering mode, an amount of time that hearing devices 106 are not in the wireless audio rendering mode.

In this example, hearing devices 106 may not re-enter the wireless audio rendering mode until the tracked amount of time is greater than a predetermined threshold, regardless of whether the signal quality measure of the wireless signal as determined by hearing device 106-1 is greater than the upper threshold level. Once the tracked amount of time is greater than the predetermined threshold, hearing devices 106 may enter the wireless audio rendering mode in response to hearing device 106-1 determining that the signal quality measure of the wireless signal is greater than the upper threshold level, as described herein.

As another example, in some embodiments, the criterion to exit the wireless audio rendering mode is applied only if a preconfigured amount of time has elapsed since the wireless audio rendering mode has been entered by hearing devices 106. To this end, hearing device 106-1 and/or hearing device 106-2 may track an amount of time that hearing devices 106 are in the wireless audio rendering mode.

In this example, hearing devices 106 may not exit the wireless audio rendering mode until the tracked amount of time is greater than a predetermined threshold, regardless of whether the signal quality measures of the wireless signal drop below the lower threshold level. Once the tracked amount of time is greater than the predetermined threshold, hearing devices 106 may exit the wireless audio rendering mode as described herein.

In some embodiments, the criterion to enter the wireless audio rendering mode is applied only if one or more physical distance conditions are met. To this end, hearing devices 106 and remote audio source 104 may implement functionality that enable hearing devices 106 to measure a physical distance between hearing devices 106 and remote audio source 104. For example, hearing devices 106 may be configured to detect angles of departure of a wireless signal from remote audio source 104, e.g., based on the angle of departure method of Bluetooth direction finding. The angles of departure as measured independently at hearing devices 106 may be combined through triangulation, using the known distance between the user's ears to derive an estimate of the physical distance from hearing devices 106 to remote audio source 104.

Accordingly, hearing device 106-1 and/or hearing device 106-2 may track, commencing with hearing devices 106 exiting the wireless audio rendering mode, a physical distance between hearing devices 106 and remote audio source 104 (e.g., based on detected angles of departure). In some embodiments, a re-entering of hearing devices 106 into the wireless audio rendering mode is not performed until the physical distance is reduced by more than a predetermined distance.

Additionally or alternatively, in configurations in which hearing devices 106 monitor the wireless signal quality from multiple remote audio sources, hearing devices 106 may be configured to enter the audio rendering mode only for the remote audio source with the shortest physical distance to hearing devices 106.

For example, hearing device 106-1 and/or hearing device 106-2 may track, commencing with hearing devices 106 exiting the wireless audio rendering mode, a first physical distance between hearing devices 106 and remote audio source 104. Concurrently, hearing device 106-1 and/or hearing device 106-2 may track, commencing with hearing devices 106 exiting the wireless audio rendering mode, a second physical distance between hearing devices 106 and an additional remote audio source. In some examples, for hearing devices 106 to re-enter the wireless audio rendering mode associated with remote audio source 104, the first physical distance must be less than the second physical distance.

In some examples, remote audio source 104 may be configured to transmit data indicating the physical range from the remote audio source 104 within which it is recommended to render the audio from remote audio source 104, e.g., to confine listening to a predetermined area like to a specific room, lobby area etc. Accordingly, hearing device 106-1 and/or hearing device 106-2 may track the physical distance between hearing devices 106 and remote audio source 104 and prevent hearing devices 106 from re-entering into the wireless audio rendering mode until the physical distance is within a recommended distance associated with remote audio source 104.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method to operate a first and a second hearing device in a binaural hearing system, comprising:

determining, by the first hearing device while the first and second hearing devices are in a wireless audio rendering mode in which both the first and second hearing devices render a remote audio stream from a remote audio source to a user of the binaural hearing system, that a first signal quality measure of the remote audio stream received at the first hearing device drops below a lower threshold level;

determining, by the second hearing device while the first and second hearing devices are in the wireless audio rendering mode, that a second signal quality measure of the remote audio stream received at the second hearing device drops below the lower threshold level; and exiting, by both the first hearing device and the second hearing device, the wireless audio rendering mode in response to but not before both the first signal quality measure and the second signal quality measure of the remote audio stream drop below the lower threshold level.

2. The method of claim 1, further comprising:

tracking, by at least one of the first hearing device or the second hearing device, an amount of time that the first and second hearing devices are in the wireless audio rendering mode;

wherein the exiting the wireless audio rendering mode by both the first hearing device and the second hearing device is not performed until the amount of time is greater than a predetermined threshold.

3. The method of claim 1, further comprising:

determining, by the first hearing device prior to the first and second hearing devices being in the wireless audio rendering mode, that a signal quality measure of a wireless signal transmitted by the remote audio source is greater than an upper threshold level; and entering, by both the first hearing device and the second hearing device, in response to the first hearing device determining that the signal quality measure of the wireless signal is greater than the upper threshold level, the wireless audio rendering mode.

4. The method of claim 1, further comprising:

tracking, by at least one of the first hearing device or the second hearing device commencing with the exiting, an amount of time that the first and second hearing devices are not in the wireless audio rendering mode;

wherein a re-entering of the first and second hearing devices into the wireless audio rendering mode is not performed until the amount of time is greater than a predetermined threshold.

5. The method of claim 1, further comprising:

tracking, by at least one of the first hearing device or the second hearing device commencing with the exiting, a physical distance between the hearing devices and the remote audio source;

wherein a re-entering of the first and second hearing devices into the wireless audio rendering mode is not performed until the physical distance is reduced by more than a predetermined distance.

6. The method of claim 5, further comprising:

detecting, by the first hearing device, a first angle of departure of the wireless signal from the remote audio source; and detecting, by the second hearing device, a second angle of departure of the wireless signal from the remote audio source;

wherein the tracking of the physical distance is based on the first and second angles of departure.

7. The method of claim 1, further comprising:

tracking, by at least one of the first hearing device or the second hearing device commencing with the exiting, a first physical distance between the hearing devices and the remote audio source; and tracking, by at least one of the first hearing device or the second hearing device commencing with the exiting, a second physical distance between the hearing devices and an additional remote audio source;

wherein a re-entering of the first and second hearing devices into the wireless audio rendering mode is only performed when the first physical distance is less than the second physical distance.

8. The method of claim 1, further comprising:

tracking, by at least one of the first hearing device or the second hearing device commencing with the exiting, a physical distance between the hearing devices and the remote audio source;

wherein a re-entering of the first and second hearing devices into the wireless audio rendering mode is not performed until the physical distance is within a recommended distance associated with the remote audio source.

9. The method of claim 1, wherein:

the determining that the first signal quality measure of the remote audio stream drops below the lower threshold level occurs at a first time;

the determining that the second signal quality measure of the remote audio stream drops below the lower threshold level occurs at a second time;

the method further comprises remaining, by both the first hearing device and the second hearing device, in the wireless audio rendering mode during a time period between the first time and the second time.

10. The method of claim 1, further comprising:

transmitting, by the second hearing device via a binaural communication link between the first and second hearing devices and in response to the determining that the second signal quality measure of the remote audio stream is less than the lower threshold level, a signal to the first hearing device, the signal indicating that the second signal quality measure of the remote audio stream is less than the lower threshold level; and transmitting, by the first hearing device via the binaural communication link in response to receiving the signal and in response to determining that the first signal quality measure of the remote audio stream is less than the lower threshold level, a command, the command configured to direct the second hearing device to exit the wireless audio rendering mode.

11. A binaural hearing system comprising:

a first hearing device associated with a first ear of a user, a second hearing device communicatively coupled to the first hearing device by way of a binaural communication link and associated with a second ear of the user, wherein the first hearing device is configured to determine, while the first and second hearing devices are in a wireless audio rendering mode in which both the first and second hearing devices render a remote audio stream from a remote audio source to a user of the binaural hearing system, that a first signal quality measure of the remote audio stream received at the first hearing device drops below a lower threshold level, the second hearing device is configured to determine, while the first and second hearing devices are in the wireless audio rendering mode, that a second signal quality measure of the remote audio stream received at the second hearing device drops below the lower threshold level, and the first and second hearing device are configured to exit the wireless audio rendering mode in response to but not before both the first signal quality measure and the second signal quality measure of the remote audio stream drop below the lower threshold level.

12. The binaural hearing system of claim 11, wherein:

at least one of the first hearing device or the second hearing device is configured to track an amount of time that the first and second hearing devices are in the wireless audio rendering mode; and the exiting the wireless audio rendering mode by both the first hearing device and the second hearing device is not performed until the amount of time is greater than a predetermined threshold.

13. The binaural hearing system of claim 11, wherein:

the first hearing device is configured to determine, prior to the first and second hearing devices being in the wireless audio rendering mode, that a signal quality measure of a wireless signal transmitted by the remote audio source is greater than an upper threshold level; and both the first and second hearing devices are configured to enter, in response to the first hearing device determining that the signal quality measure of the wireless signal is greater than the upper threshold level, the wireless audio rendering mode.

14. The binaural hearing system of claim 11, wherein:

at least one of the first hearing device or the second hearing device is configured to track, commencing with the exiting, an amount of time that the first and second hearing devices are not in the wireless audio rendering mode; and a re-entering of the first and second hearing devices into the wireless audio rendering mode is not performed until the amount of time is greater than a predetermined threshold.

15. The binaural hearing system of claim 14, wherein:

the second hearing device is configured to transmit, via a binaural communication link between the first and second hearing devices and in response to the determination that the second signal quality measure of the remote audio stream is less than the lower threshold level, a signal to the first hearing device, the signal indicating that the second signal quality measure of the remote audio stream is less than the lower threshold level, and the first hearing device is configured to transmit, via the binaural communication link in response to receiving the signal and in response to the determining that the first signal quality measure of the remote audio stream is less than the lower threshold level, a command to the second hearing device, the command configured to direct the second hearing device to exit the wireless audio rendering mode.

16. The binaural hearing system of claim 11, wherein:

at least one of the first hearing device or the second hearing device is configured to track, commencing with the exiting, a physical distance between the hearing devices and the remote audio source; and a re-entering of the first and second hearing devices into the wireless audio rendering mode is not performed until the physical distance is reduced by more than a predetermined distance.

17. The binaural hearing system of claim 16, wherein:

the first hearing device is configured to detect a first angle of departure of the wireless signal from the remote audio source;

the second hearing device is configured to detect a second angle of departure of the wireless signal from the remote audio source; and the tracking of the physical distance is based on the first and second angles of departure.

18. The binaural hearing system of claim 11, wherein:

at least one of the first hearing device or the second hearing device is configured to track, commencing with the exiting, a first physical distance between the hearing devices and the remote audio source;

at least one of the first hearing device or the second hearing device is configured to track, commencing with the exiting, a second physical distance between the hearing devices and an additional remote audio source; and wherein a re-entering of the first and second hearing devices into the wireless audio rendering mode is only performed when the first physical distance is less than the second physical distance.

19. The binaural hearing system of claim 11, wherein:

at least one of the first hearing device or the second hearing device is configured to track, commencing with the exiting, a physical distance between the hearing devices and the remote audio source; and a re-entering of the first and second hearing devices into the wireless audio rendering mode is not performed until the physical distance is within a recommended distance associated with the remote audio source.

20. The binaural hearing system of claim 11, wherein:

the first hearing device is configured to determine that the first signal quality measure of the remote audio stream drops below the lower threshold level at a first time;

the second hearing device is configured to determine that the second signal quality measure of the remote audio stream drops below the lower threshold level at a second time; and the first and second hearing devices are configured to remain in the wireless audio rendering mode during a time period between the first time and the second time.

* * * * *